US006163989A

United States Patent [19]

Kaczmarski et al.

[11] Patent Number: 6,163,989

[45] **Date of Patent: *Dec. 26, 2000**

[54] FRAME FOR MOUNTING ON A BOOM MOUNTED QUICK CHANGE BRACKET

[75] Inventors: Wally L. Kaczmarski, Lisbon; Thomas M. Sagaser, Bismarck; Craig A. Berard, Oakes; Henry J. Weber; Jason J. Asche, both of Bismarck, all of N. Dak.

[73] Assignee: Clark Equipment Company, Woodcliff Lake, N.J.

[ * ] Notice: This patent is subject to a terminal disclaimer.

[21] Appl. No.: 09/028,074

[22] Filed: Feb. 23, 1998

Related U.S. Application Data

[63] Continuation-in-part of application No. 08/814,313, Mar. 10, 1997, Pat. No. 5,974,706.

[51] Int. Cl.[7] ..... E02F 3/36

[52] U.S. Cl. ..... 37/468; 37/903

[58] Field of Search ..... 172/272, 275; 37/468, 903

[56] References Cited

U.S. PATENT DOCUMENTS

| | | | |
|---|---|---|---|
| 2,963,183 | 12/1960 | Przybylski . | |
| 3,237,795 | 3/1966 | Kromer . | |
| 4,213,731 | 7/1980 | Verachtert | 414/723 |
| 4,214,840 | 7/1980 | Beales | 403/31 |
| 4,225,283 | 9/1980 | Baker et al. | 414/723 |
| 4,477,101 | 10/1984 | Nilsson et al. | 172/272 X |
| 4,480,955 | 11/1984 | Andrews et al. | 414/723 |
| 4,632,595 | 12/1986 | Schaeff | 403/330 |
| 4,929,143 | 5/1990 | Dohnalik | 414/723 |
| 5,024,010 | 6/1991 | Hulden | 37/468 |
| 5,082,389 | 1/1992 | Balemi | 403/322 |
| 5,098,252 | 3/1992 | Sheesley et al. | 414/723 |
| 5,107,610 | 4/1992 | Fusco | 37/103 |
| 5,110,254 | 5/1992 | Aubrey | 414/723 |

(List continued on next page.)

FOREIGN PATENT DOCUMENTS

| | | | |
|---|---|---|---|
| 1071151 | 2/1980 | Canada | 37/468 |
| 0 321 902 A1 | 6/1989 | European Pat. Off. . | |
| 0 472 115 | 2/1992 | European Pat. Off. . | |
| 0 521 560 B1 | 1/1993 | European Pat. Off. . | |
| 0 637 649 | 2/1995 | European Pat. Off. . | |
| 0 672 796 | 9/1995 | European Pat. Off. . | |
| 2 690 718 | 11/1993 | France . | |
| 90 00 721 | 4/1990 | Germany . | |
| 7904335 | 12/1980 | Netherlands | 37/468 |
| 763531 | 9/1980 | U.S.S.R. | 37/468 |

(List continued on next page.)

OTHER PUBLICATIONS

P. 175 from Construction Equipment entitled "Equipment Ideas", publication date is unknown but admitted prior art.

Web pages from Weldco–Beales, pp. 1 and 2, entitled "About Weldco".

Pages from Weldco–Beales website, pp. 1 and 2, entitled "Excavator Attachments".

Weldco–Beales Mfg. Inc., brochure, two pages, entitled "Mini Excavator Universal Attachment System", publication date is 1999 (admitted prior art).

Weldco–Beales Mfg. Ltd., brochure, one page, entitled "Does your Quick Coupler System Measure Up?", publication date Mar. 1998 (admitted prior art).

Weldco–Beales Mfg. Inc., brochure, two pages, entitled "Excavator Quick Couplers", publication date 1999.

Kenco brochure, one page, entitled "Universal Attachment System", publication date unknown (admitted prior art).

*Primary Examiner*—Christopher Novosad

*Attorney, Agent, or Firm*—Westman, Champlin & Kelly, P.A.

[57] ABSTRACT

A quick attach accessory tool mounting frame is adapted to be mounted onto a quick attachment bracket and held in place. The adapter frame has spaced side plates that slide over a bracket and with a linear movement can be held in place on the bracket. The frame has an adapter plate that can be used with brackets to mount on a wide variety of auxiliary tools used with a backhoe or excavator.

24 Claims, 12 Drawing Sheets

U.S. PATENT DOCUMENTS

| | | | |
|---|---|---|---|
| 5,145,313 | 9/1992 | Weyer | 414/723 |
| 5,147,173 | 9/1992 | Fauber et al. | 414/723 |
| 5,332,353 | 7/1994 | Arnold | 414/723 |
| 5,333,695 | 8/1994 | Walter | 172/272 |
| 5,350,250 | 9/1994 | Nagler | 403/316 |
| 5,415,235 | 5/1995 | Gebauer | 37/468 |
| 5,431,528 | 7/1995 | Jenkins et al. | 37/468 |
| 5,597,283 | 1/1997 | Jones | 37/468 |
| 5,692,325 | 12/1997 | Kuzutani | 37/468 |
| 5,727,342 | 3/1998 | Horton | 37/468 |

FOREIGN PATENT DOCUMENTS

| | | | |
|---|---|---|---|
| 2 040 262 | 8/1980 | United Kingdom . | |
| 2 068 332 | 8/1981 | United Kingdom . | |
| 2169582 | 7/1986 | United Kingdom | 37/468 |
| 8802421 | 4/1988 | WIPO | 37/468 |

22
22A
18
16
19A
19C
19B
24
28
46
44
59A
58
45
32
19D
84
33
32A
53
52C
52F
48
43
26
52B
73
52H
72
30
40
36
54
38A
50
52A
49C
52
79
49D
20A
49
20

FRAME FOR MOUNTING ON A BOOM MOUNTED QUICK CHANGE BRACKET

CROSS REFERENCE TO RELATED APPLICATION

This application is a continuation-in-part of application Ser. No. 08/814,313, filed Mar. 10, 1997, now U.S. Pat. No. 5,974,706, for ATTACHMENT CONSTRUCTION FOR EARTHWORKING IMPLEMENT.

BACKGROUND OF THE INVENTION

The present invention relates to a mounting frame for attachment to a tool such as a clamshell, bucket, grapple, or power unit support for an auger, hydraulic hammer, or compactor, that will permit quick attachment to a bracket on an arm or boom, such as a backhoe or excavator arm.

With the advance of reliable, positive locking quick attachment brackets, it has become desirable to use a quick attachment arrangement for interchanging buckets, power earth augers, compactors, clam shells, grapples, breakers and other implements as well.

Efforts have been made to provide couplings that can automatically connect tools to an articulated arm of an excavator, backhoe or the like, but most of these require operator action, as well as lacking reliability. Many of the present quick attachment brackets are complicated and time consuming in operation, requiring mechanically removing pins for connection as well as disconnection. One of the prior art couplings is illustrated in U.S. Pat. No. 5,110,254.

A readily used frame that will easily adapt for use on a wide variety of attachments is desired.

SUMMARY OF THE INVENTION

The present invention relates to a mounting frame having an adapter plate that can be attached to a wide range of tools and accessories for a backhoe or excavator, or other implements that support a mating quick change bracket. The mounting frame permits quick attachment to a boom or arm and is adaptable to be used with several types of tools. The frame can be welded to the tool, or in cases where the tool normally is attached to an arm with pin connectors, the frame can include an adapter plate that pins to the existing pin holes on the tool. The frame can be otherwise supported on the tool as well.

When the frame has an adapter that is pinned or bolted onto the tool, one frame can be used with several different tools that attach to a quick attachment bracket on a boom or arm. The mounting frame will mount onto a quick attachment bracket, and is locked in place for use.

In a preferred form of the present invention a quick attachment bracket is mounted on a backhoe or excavator arm and the mounting frame couples to the quick attachment bracket. The quick attachment bracket is pivoted on the arm and also connected to the operating linkage used for controlling the tool. The quick attachment bracket can be pivoted about a horizontal axis under power.

The quick attachment bracket as shown carries a spring loaded latch member that is pivotally mounted on the bracket so it will pivot to a position wherein it will engage and hold a frame on a bucket or tool. The quick attachment bracket and the mounting frame of the present invention on the tool are made to slide together. As the bracket slides into place on the mounting frame under power operation of the boom or arm, the mounting frame seats in a receptacle on the bracket at one end and receives and retains a nose piece of the quick attachment bracket in a retainer slot formed by encircling walls at the other end of the frame. When an automatic latch is provided, the latch pivots out of the way to accommodate the latching movement of the bracket relative to the frame. As the bracket seats in position on the frame, the latch snaps into place under the spring load to securely hold the frame on the bracket. The frame and bracket also can be secured by draw bolts or other fasteners.

The frame is usable on a wide variety of tools that now are pinned to linkages on the arm of a backhoe or excavator.

DETAILED DESCRIPTION OF THE PREFERRED EMBODIMENTS

Figure 1:
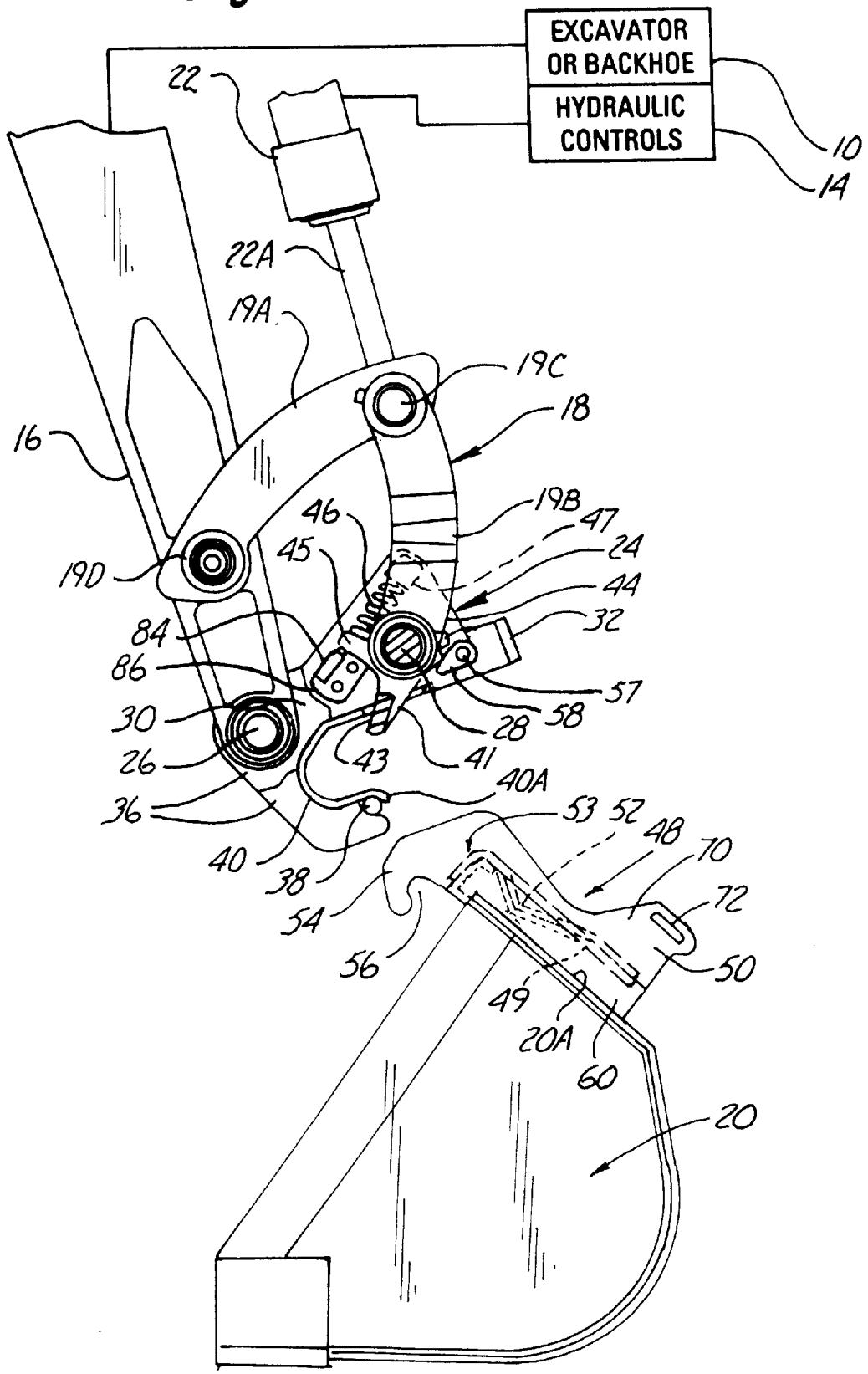
FIG. 1 is a schematic representation of a backhoe or excavator arm having a quick attachment bracket for receiving and holding a mounting frame made according to the present invention installed on a conventional bucket.

A powered implement arm 16 such as on an excavator or backhoe is used to mount an auxiliary tool, as shown a bucket 20. The arm 16 is pivotally mounted to a boom arm section that is in turn pivotally mounted to the excavator or backhoe represented at 10. The arm 16 is controlled and operated from the mounting platform, using hydraulic actuators operated from a source of hydraulic fluid under pressure, and operated by valve controls 14. An outer end of the arm 16 as shown mounts a link assembly 18 that is used for controlling pivoting of a tool represented as a bucket 20 relative to the arm 16. The link assembly 18 is actuated with a double acting hydraulic actuator shown at 22 and operated through valve 14. The actuator 22 extends and retracts an actuator rod 22A under power and controls pivotal movement of a quick attachment mounting bracket 24 that is pivotally mounted on a pin 26 to the outer end of the arm 16. The actuator 22, acting through link assembly 18 will control pivoting of the bracket 24 about the horizontal axis of the pin 26. The hydraulic actuator 22 can be attached directly to the bracket 24 to eliminate the link assembly 18, if desired.

The link assembly 18 as shown, has a pair of links 19A and 19B that are pivotally mounted together with a pin 19C. The pin 19C also is the attachment pin for the actuator rod 22A. The links 19A and 19B are suitably bifurcated to permit attachment on the single pin 19C. The link 19A is pivotally mounted to the arm 16 with the pin 19D and the outer end of link 19B is pivotally mounted to quick attachment bracket 24 with a pin 28.

Figure 2:
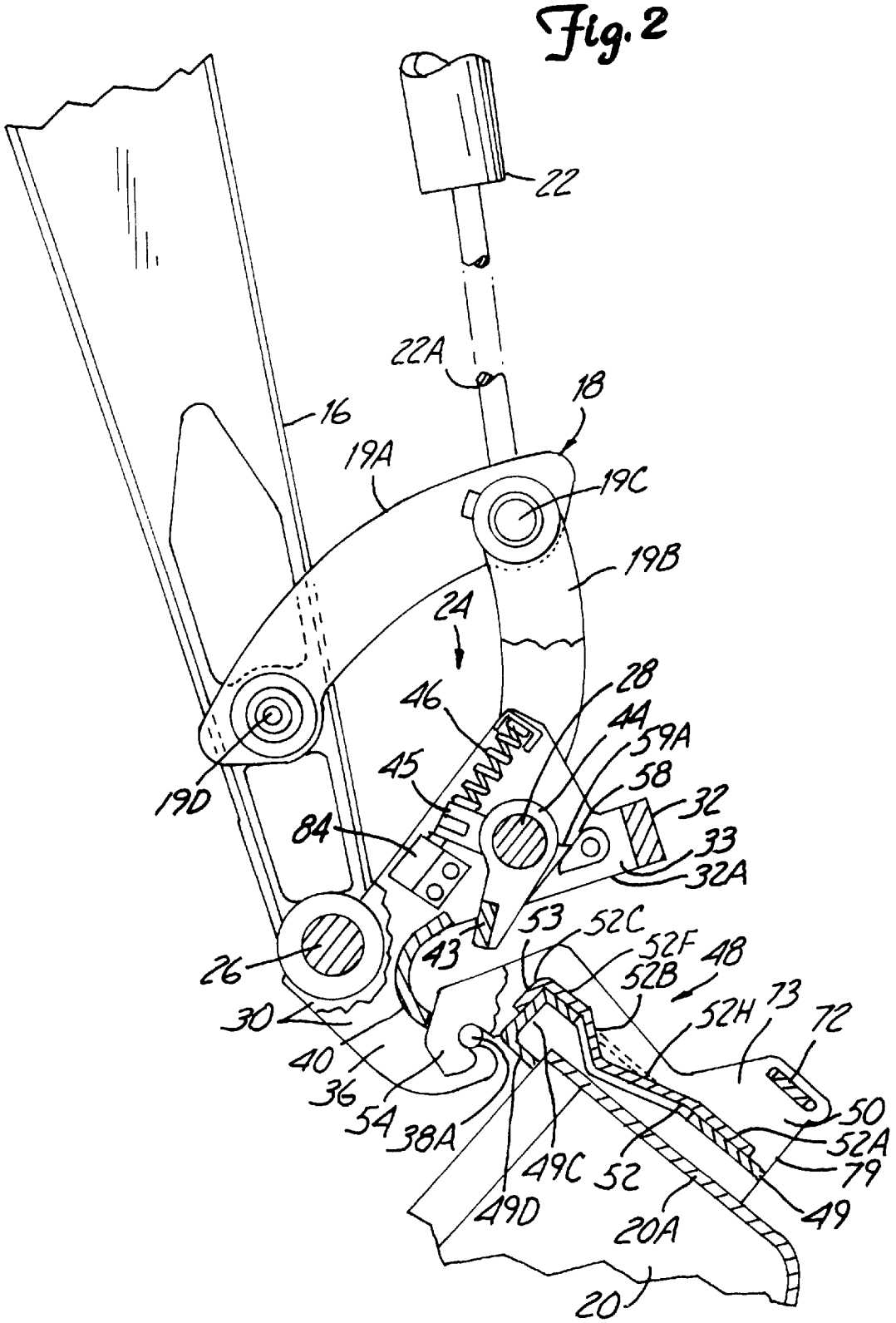
FIG. 2 is an enlarged fragmentary view with parts in section and parts broken away showing details of a quick attachment bracket and a mounting frame using an adapter plate made according to the present invention.
Figure 3:
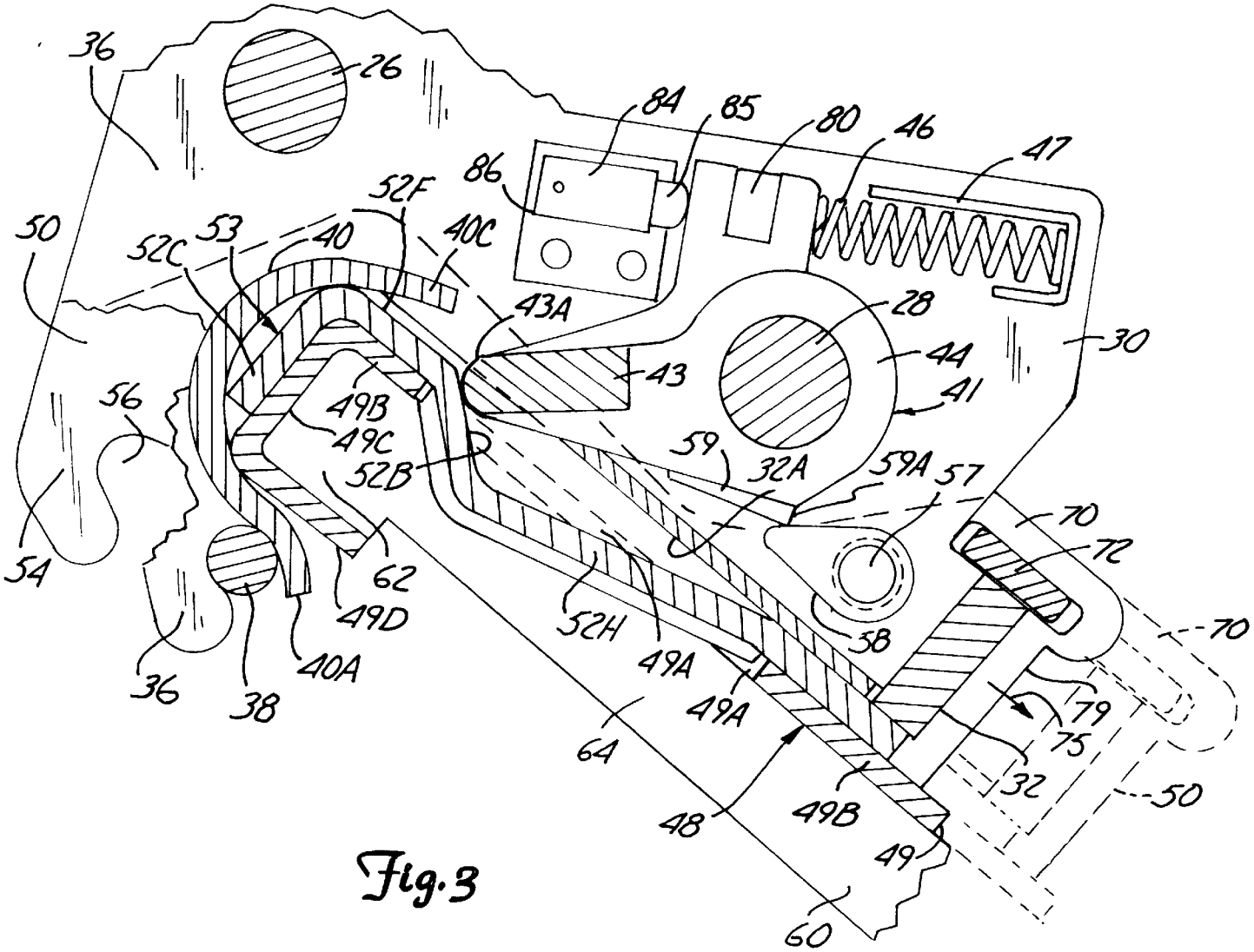
FIG. 3 is a sectional view showing a mounting frame and quick attachment bracket in a latched position.
Figure 4:
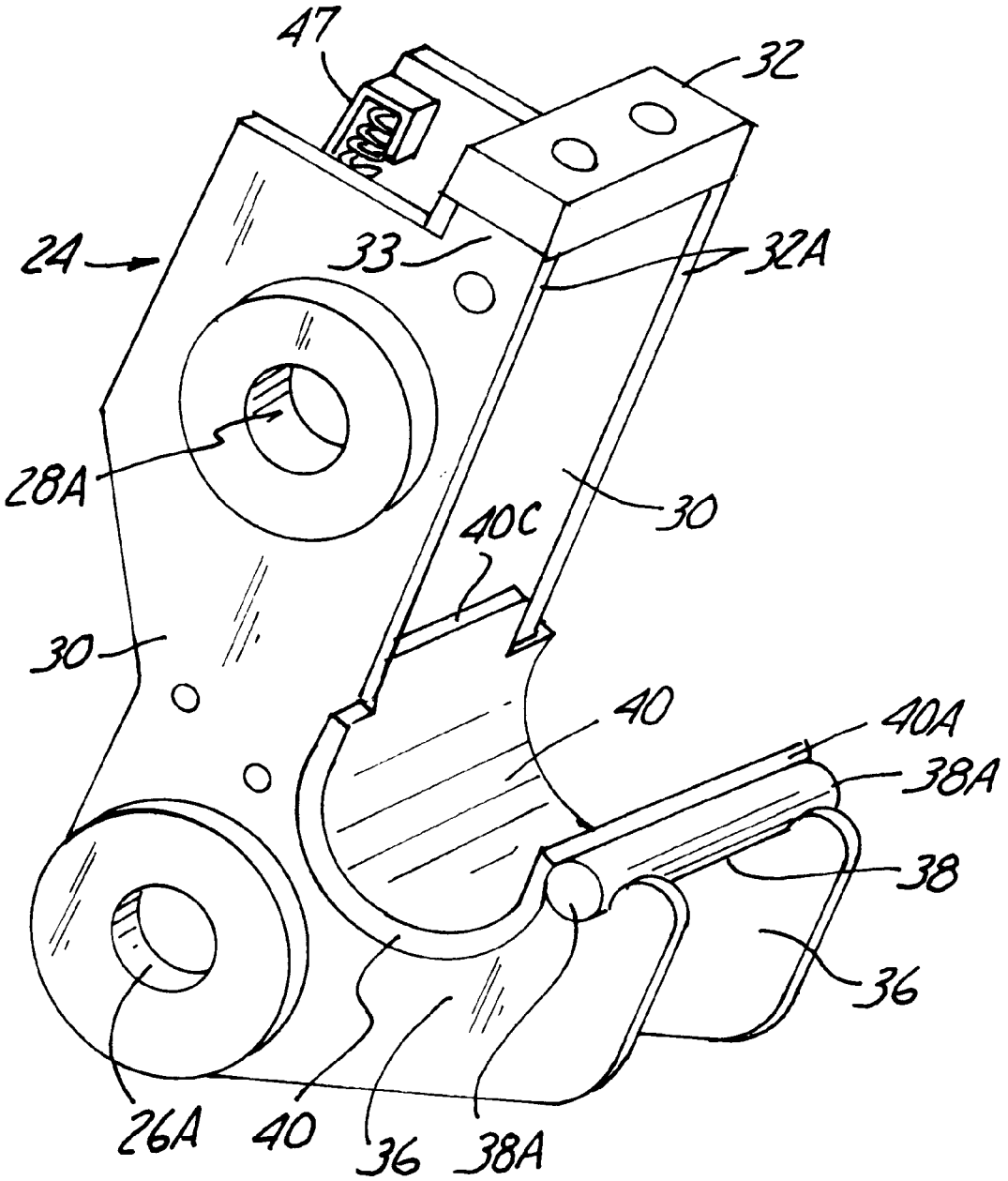
FIG. 4 is a perspective view of the quick attachment bracket detached from its supports on a backhoe or excavator arm.
Figure 5:
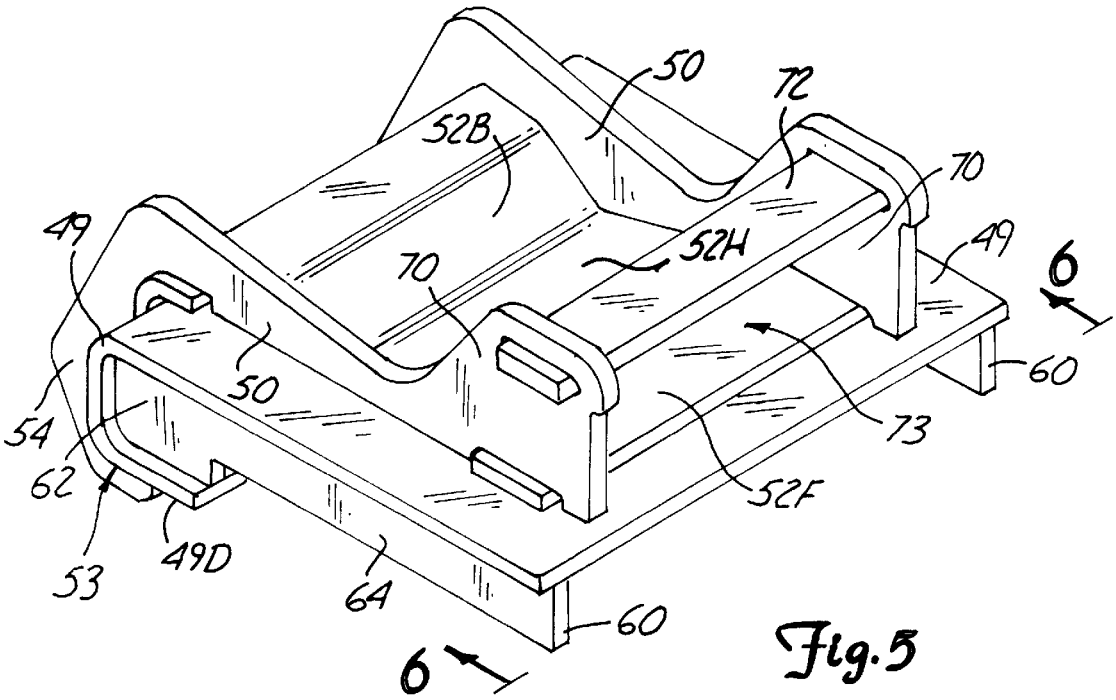
FIG. 5 is a side perspective view illustrating a mounting frame used in FIG. 1.
Figure 6:
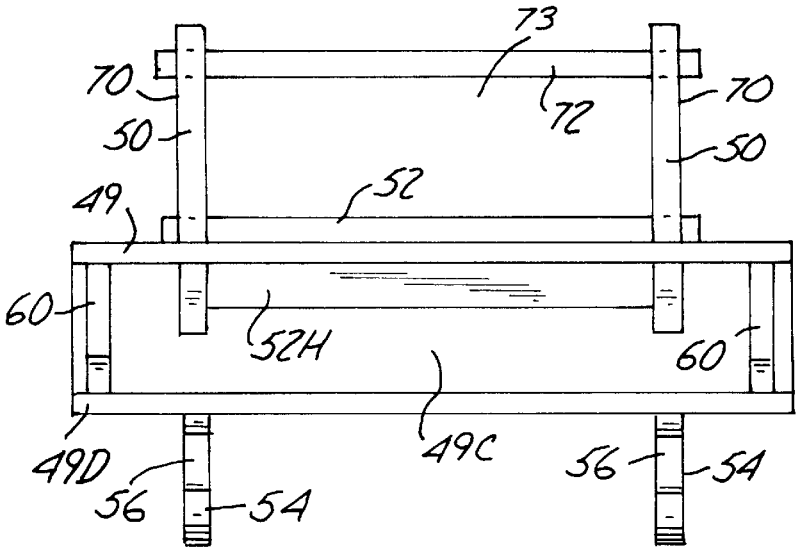
FIG. 6 is an end view taken generally along line 6—6 in FIG. 5.

The quick attachment bracket 24 as seen in FIGS. 2, 3 and 4 has a pair of side plates 30, 30 that support a bar 32 that extends across the space between the side plates 30 at a nose portion 33. The nose portion 33 is narrower in fore and aft directions and will be used to provide a latching portion. The nose bar 32 is welded to the side plates 30 to form an assembly. The side plates 30 have lower support ears 36 that are recessed to support a "C" shaped saddle or retainer 40 that is a cross member extending across the space between the side plates 30 and is welded thereto to secure the opposite ends of the plates 30 of the quick attachment bracket 24. A tongue 40C of the saddle extends between the side plates 30. The saddle is a retainer or latch portion that is at a first end of the bracket 24 and that is open in direction toward nose or latching portion 33 at a second end portion of the bracket 24.

The side plates 30 receive the main mounting pin 26 through bores 26A and the pin 26 extends across the space between the side plates 30. The linkage pin 28 also extends through bores 28A and extends across the space between the side plates 30.

A pin 38 is supported on the outer ends of the ears 36 of the side plates and is held in place partially under a lead-in lip 40A on one outer edge of the "C" shaped saddle 40. The pin 38 extends outwardly beyond the side plates 30 to provide support ends 38A, which are used to support a mounting frame 48, shown welded to the bucket in the first form of the invention, during mounting and releasing the frame and attached tool from the quick attachment bracket 24.

The pivot pin 28, as shown for automatic operation, also mounts a frame latch 41 (FIGS. 2 and 3). The latch 41 is a yoke shaped member that has a pair of latch arms 42 held together with a latch bar 43 at their outer ends. The arms 42 have hubs 44 that also have bores that pivotally mount over the pivot pin 28. The hubs 44 have control arms 45 extending therefrom, and the arms 45 are spring loaded with strong compression springs 46 that are retained in spring supports 47 that are fixed to the side plates 30 and bear against the arms 45. The end 43A of the latch 41 is rounded with a large radius for smooth engagement when latching.

The latch 41 is thus urged by the springs 46 to rotate in counterclockwise direction as shown in FIGS. 2 and 3, and the latch 41 is retained from rotating beyond a desired position, by a block or cylinder 84.

The mounting or attachment frame 48 is used to couple to quick attachment bracket 24 shown in FIGS. 1–4. The frame 48 is made up of side plates 50, 50 that are welded to a latch backing cross plate 52. The latch backing cross plate 52 is welded to an adapter cross plate 49 to make a cross plate assembly 55.

The latch backing cross plate 52 of frame 48 in the form shown, is formed to mate with and be retained by the latch 41 of quick attachment bracket 24 and is perhaps best understood from the showing in FIGS. 2 and 3. Latch backing cross plate 52 includes a planar flange portion 52A at one end. In the mid portions of the latch backing cross plate 52 it bends inwardly through opening 49A in adapter cross plate 49 that forms part of a secure mounting for attachment to a bucket or tool. An inclined latch wall section 52B and a section 52A of latch backing cross plate 52 is formed to extend through opening 49A so it protrudes through the opening to an opposite side of the adapter cross plate 49 from portion 52A. Side plates 50 support the plate 52 along its side edges and the center portions also extend through opening 49A. The latch backing cross plate 52 has a section 52F that is coplanar with planar flange portion 52A and on the same side of the plane of adapter cross plate 49 as portion 52A. The end of the backing cross plate 52 then has a flange 52C formed at right angles to the plane of the planar flange portion 52A and the wall section 52F, as well as at right angles to the main portion 49B of adapter cross plate 49.

The cross plate 49 is formed into an inverted rim channel 53, forming a latch rim or retainer with flange 52C. Flange 52C forms part of the rim or channel 53, as perhaps can be best seen by referring to FIG. 3. The channel 53 is formed with a base wall 49C bent from the plane of plate portion 49B and an outer wall 49D is formed from adapter cross plate 49 to extend back toward the opposite end of the adapter cross plate 49. The rim channel base is double thickness with flange 52C. The opening 49A formed in the adapter cross plate 49 permits the latch section 52B of latch backing cross plate 52 and portions of side plates 50 to extend to position to be engaged by latch 41 when the frame 48 is attached to the mounting bracket 24.

The side plates 50 of the frame 48 are spaced wider than the side plates 30, the bar 32 and the "C" shaped saddle 40 of bracket 24. The side plates 50 thus will fit over the outside of the quick attachment bracket 24 when the bracket 24 seats on the quick attachment frame 48. The lower ends of the side plates 50 have ear or hook ends 54 with receptacles 56 formed in them for engaging rod ends 38A for support.

The latch 41 is held in its "ready" position shown in FIG. 1 when the quick attach bracket 24 is ready to be used, and while many latch holders can be used, as shown in FIGS. 2 and 3, a pivoting pawl 58 is mounted on a shaft 57, on at least one side of the latch. The pivoting pawl 58 aligns with a hub 44 of the frame latch 41 and as shown in FIG. 3 the pawl 58 is positioned to engage a stop lug 59 integral with a hub 44. The stop lug has a stop surface 59A for holding the latch retracted in a retracted or release position. The pawl 58 is spring loaded with a torsion spring (not shown) to rotate in clockwise direction. The pawl 58 is optional, in that the latch 41 can be held in position by actuator 84, which will be explained subsequently. The end of the latch 41 protrudes into the area overlying the "C" shaped saddle 40 when the latch is in its ready position as shown in FIG. 2.

The frame 48 can also be retained in position with bolts that extend from the frame 48 to the bracket 24 to hold the frame 48 in place.

The attachment frame 48 adapter cross plate 49 forms an adapter cross plate providing a base for support of the frame to tools such as the bucket 20. The adapter plate 49 defines a reference plane for fastening additional supports that are used as welding or support brackets.

For example, in FIGS. 1 through 6, the cross plate assembly 55, including adapter cross plate 49 is supported by brackets 60 that are welded to the adapter cross plate 49 and are notched so they support the interior of channel 53 with end portions 62 and have shank lengths 64 that support the cross plate assembly 55 and are sufficiently high so the latch wall portions 52B and 52H of the latch backing cross plate 52 forming part of the cross plate assembly 55 will not interfere with the back wall of a bucket on which the frame 48 is mounted. In FIG. 1 the frame 48 is welded to a conventional bucket back wall 20A. Using the adapter cross plate 49 and the brackets 60 makes it possible to convert buckets with pivot pin brackets to be mounted on a quick exchange system, by cutting off the existing brackets and welding on the frame 48 using the brackets 60 and the adapter plate 49.

The attachment frame 48 and the added brackets 60 permit mounting the attachment frame through the adapter cross plate to any tool that has a flat wall that is the normal attachment location for the tool.

The channel 53 forms a first latching rim or interlocking retainer engaging the quick attachment bracket 24. The interlocking of channel or rim 53 is done with a linear motion, and the first end of the attachment bracket 24 has a receptacle, the C shaped saddle 40, that is open in direction toward the nose piece or latching portion 33 and forms a first interlocking latching portion for engagement with rim or channel 53, while the nose piece 33 forms a second latching portion.

The side plates 50 have spaced apart ears 70 that protrude from the plate 52. These ears 70 have slots that receive a cross retainer wall or bar 72, that is thus spaced from the parallel plate portion 52A of plate assembly 55 to form a receiver slot 73 for the nose portion 33 and nose bar 32 at an end of frame 48 opposite from rim channel 53. Upon sliding the quick attachment bracket 24 into latched position along latch backing cross plate 52 after the bracket has been pivoted clockwise in FIG. 2 until the edges 32 rest on plate portions 52A and 52F, the cross nose bar 32 and nose piece 33 will pass between the bar 72 and the plate portion 52A as the channel or rim 53 seats in the receptacle formed by C shaped channel 40 on the quick attachment bracket 24.

The attachment frame 48 can easily be installed on the quick attachment bracket 24 on the arm 16 using a procedure shown schematically in FIGS. 2 and 3. When the bucket 20 or other tool is to be attached to the arm 16, the receptacles 56 of side plates 50 are hooked onto the ends 38A of the rod 38, with the bucket or tool in an appropriate stored position. As shown, the bucket can be stored by resting it on the ground. Elongated tools can be stored either to be in a substantially horizontal position, or supported in a vertical rack. Moving the arm 16 to the desired location and extending the actuator 22 will roll the quick attachment bracket 24 so that the nose bar 32 and nose piece or portion 33 fit between the side plates 50, 50 and edges 32A can be rested against the plate portions 52A and 52F, which are part of plate assembly 55, when the receptacles 56 are supported on rod ends 38A. The relative position of frame 48 is shown in dotted lines in FIG. 3. The channel or rim 53, including flange 52C, forms a retainer rim end that slips into the "C" shaped saddle 40 receptacle or retainer by moving the arm 16 about its mounting pivot to linearly slide the attachment bracket 24 in direction as indicated by arrow 75 in FIG. 3 to engage and retain both ends of the attachment frame. The rim or channel 53 is held in "C" shaped member 40 and the nose piece or portion 33 slides under the bar 72 to be held in slot 73 formed by by bar 72, plate portion 52A and side plates 50 so the nose piece or portion 33 and bracket 24 cannot pivot away from the cross plate assembly 55.

Figure 12:
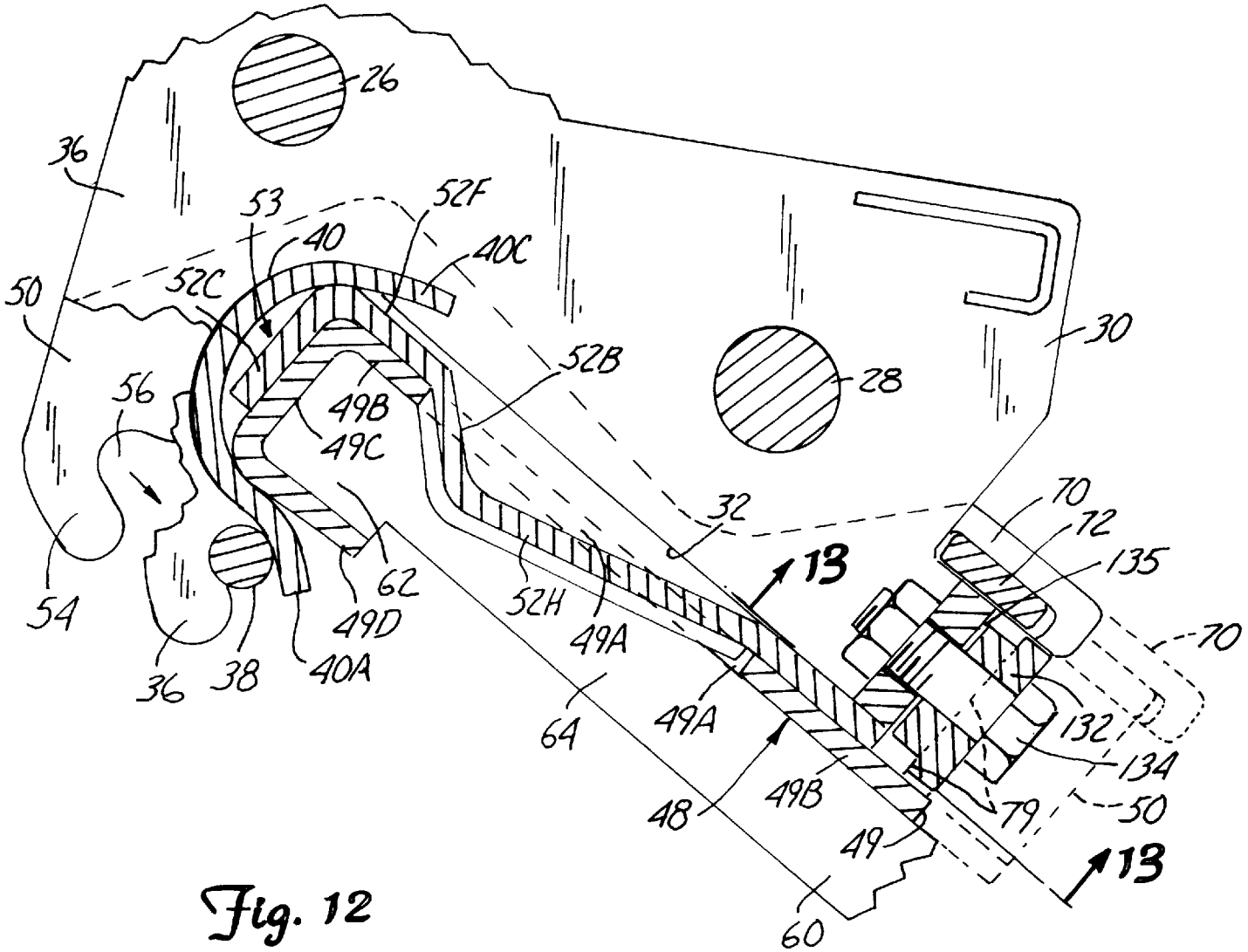
FIG. 12 is a sectional view similar to FIG. 3 showing a bolt on connection for the frame.

The latch 41, and in particular the ends of arms 42 and the cross member 43, will slide out of the way as the quick attachment bracket 24 moves into position on the frame 48 until the frame is retained by the saddle 40 and the nose piece or portion 33, is held in slot 73 by the cross bar 72. The latch 41 will slide on the plate portion 52F and will then spring back to cause the end 43A to rest against the inclined latch plate section 52B of plate 52 and hold the quick attachment frame 48 securely on the quick attachment bracket 24. Again, the nose bar 32 can be attached to a cross member supported on the top edges of the ears 70 with bolts, if the automatic latch is not used, as shown in FIG. 12.

The latch 41 can be released for disconnecting frame 48 by actuating suitable actuators 84 that are mounted on brackets 86 on the side plates 30. The actuators 84 have rods 85 that act on the arms 45 and retract the latch 41 to clear the latch backing cross plate 52 and permit the quick attachment frame 48 to be released from the quick attachment bracket 24. Pawl 58 will seat on the surface 59A to hold the latch 41 in its released position after the quick attachment frame 48 has been removed. The pawl 58 is spring loaded with a torsion spring toward the surface 59A. A pry bar or lever can be used in recess 80 for unlatching the latch 44, for manual operation. For unlatching the motion of the bracket 24 can be reversed to move so the frame 48 is in the relative dotted position of FIG. 3. The receptacles 56 will receive the ends 38A of rod 38, so as the bracket 24 is lifted away from the frame 48 and the tool, the frame 48 and tool will hang on rod 38 for permitting movement to a stored location.

The bucket 20 or other tool thus can be quickly attached to or removed from a backhoe or excavator arm when using the adapter cross plate 49 and frame of the present invention.

Figure 7:
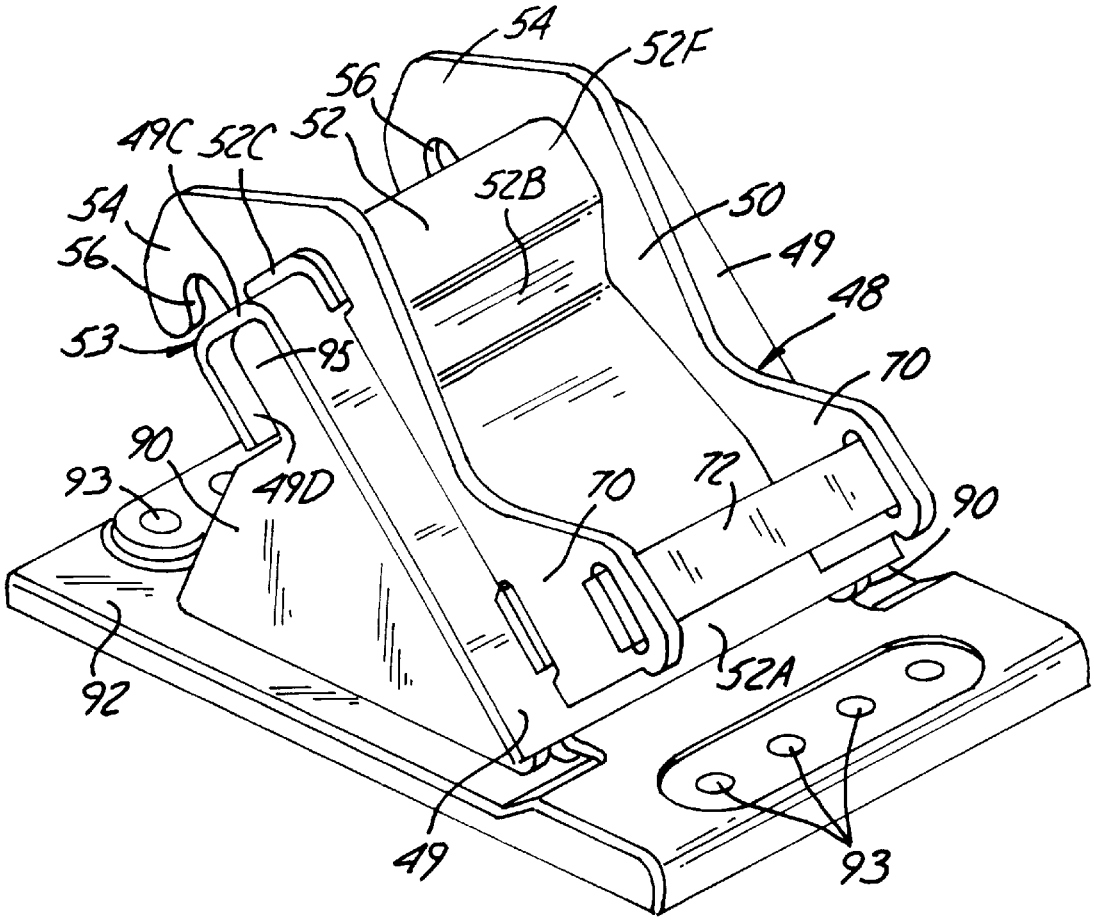
FIG. 7 is a perspective view of a mounting frame coupled to a bolt on attachment plate through support bracket.
Figure 8:
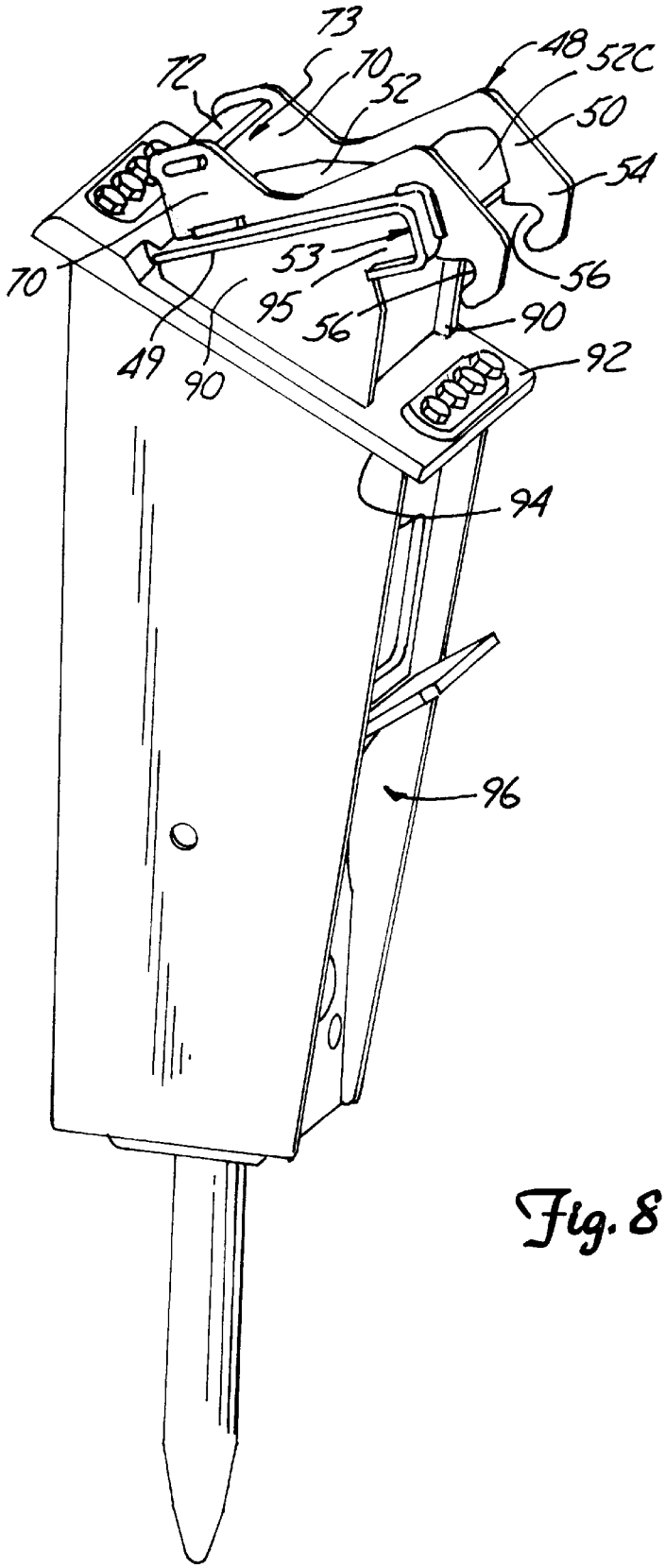
FIG. 8 is a perspective view of the mounting frame of FIG. 7 installed on a power unit.

The adapter cross plate 49 and frame 48 for receiving the quick attachment bracket are usable in a wide variety of installations. The adapter cross plate 49 and attachment frame 48 are shown in FIGS. 7 and 8 assembled to a bolt on plate used with a hydraulic breaker tool. The brackets 60 are replaced with standoff brackets 90 that form a desired angle to tilt the plate 49 relative to the bolt on plate 92. The plate 92 has bolt holes 93 at its edges. The standoff brackets 90 are positioned along the opposite sides of the cross plate 49 and provide clearance for the latch bracket. The lifting recesses or receptacles 56 are raised so there is clearance to attach the bracket 24 in the manner shown in FIG. 3. FIG. 8 is a perspective view from the opposite side from FIG. 7 and shows the plate 92 bolted to the frame or housing 94 of a hydraulic breaker 96. The hydraulic motor is not shown, but is on the interior of the frame or housing 94.

The attachment frame 48 in FIGS. 7 and 8 is numbered as in the previous form of the invention, and the rim channel 53, including plate portion 52C are reinforced and supported with a projecting section 95 of the brackets 90 that fits inside the channel formed. The attachment bracket 24 is attached to the frame 48 as described before, with the rod ends 38A supporting the frame 48 through the receptacles 56 in the side plates 50, and then rolling the bracket 24 against the cross plate assembly 55. The bracket 24 is then slid to push the nose piece or portion 33 into the slot 73 as the rim or channel 53 seats in "C" shaped saddle 40 so the frame 48 is retained on the quick attachment bracket. The latch 41 then locks the two parts together, or the two parts can be bolted to hold them from reverse movement, which reverse movement uncouples the frame and bracket.

Figure 9:
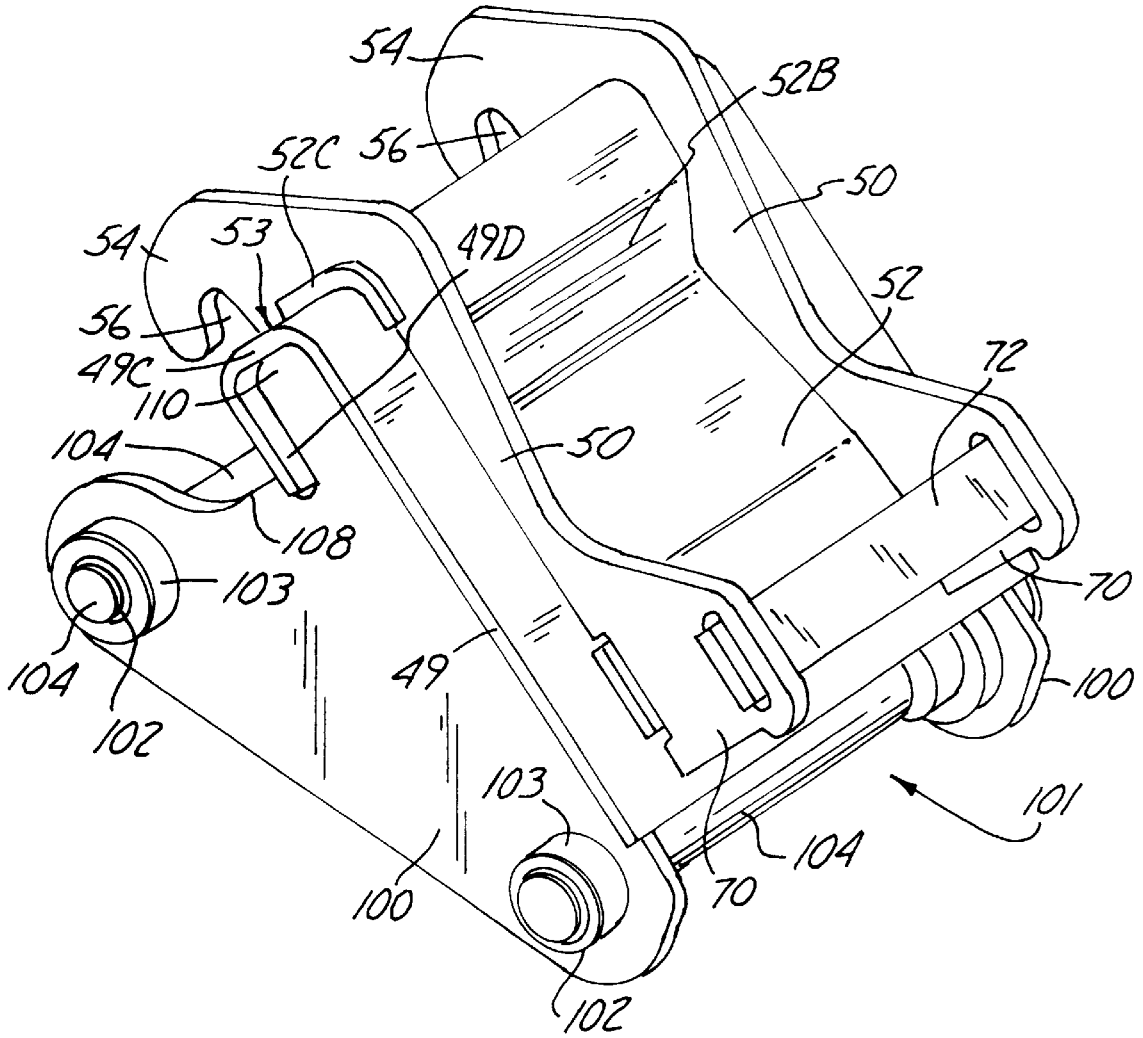
FIG. 9 is a perspective view of the mounting frame connected to a pin bracket.
Figure 10:
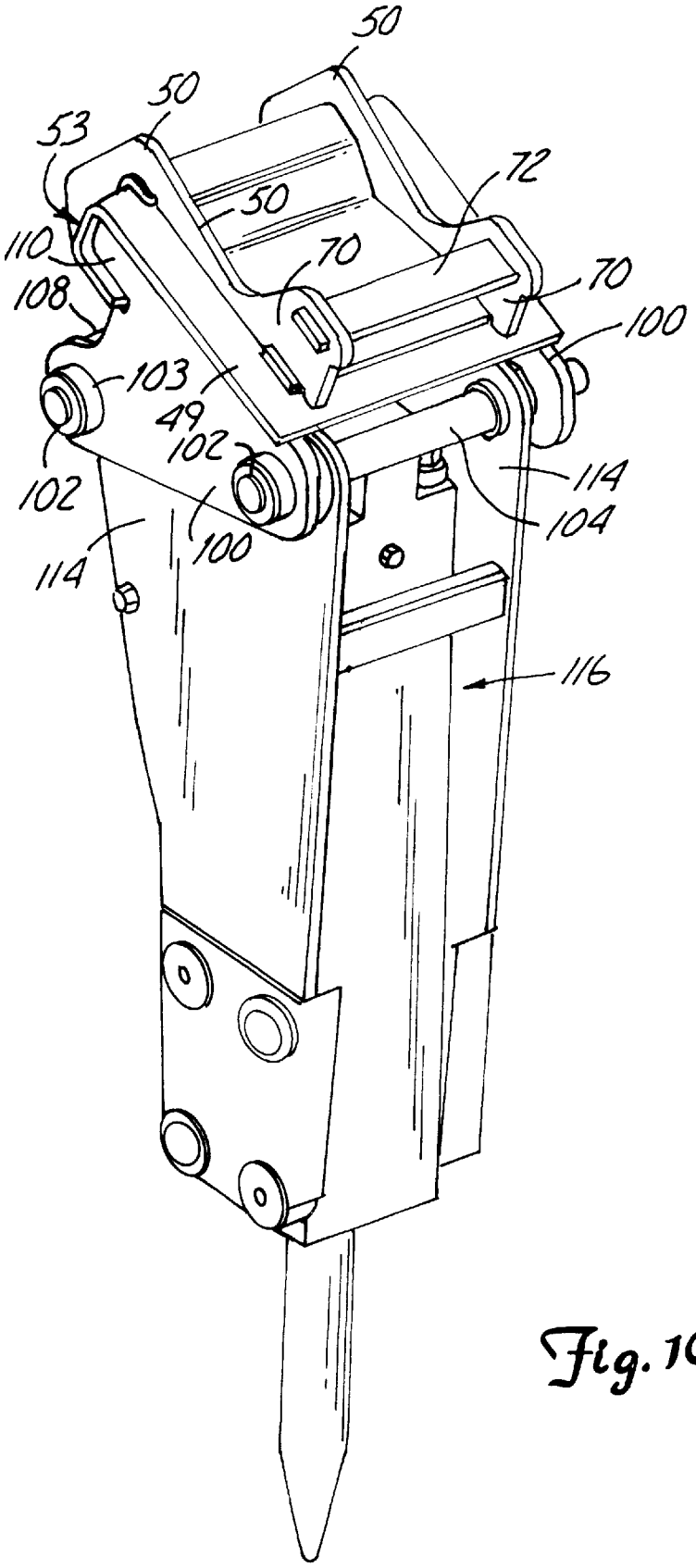
FIG. 10 is a perspective view of the mounting frame and brackets shown in FIG. 9 attached with pins to a power tool.

FIGS. 9 and 10 show the attachment frame and adapter plate mounted on brackets for use with an implement the has existing pin connections for attachment to a boom or arm. Such pin connections can be pins such as pins 26 and 28 shown in FIGS. 1 and 2, so the auxiliary tool is supported directly on the linkage on the boom. In this form of the invention, the frame 48 is made as before and has side standoff brackets 100 welded to opposite edges of the adapter cross plate 49, which forms part of the cross plate assembly 55, and which has the end channel 53 that is retained in the quick attachment bracket 24. The frame 48 and standoff brackets 100 make an adapter assembly 101. The standoff brackets 100 have pin openings 102 surrounded by hubs 103 that align between the spaced standoff brackets 100. There are two set of openings 102 on each of the standoff brackets 100. The openings are of size to receive mounting pins 104 of standard size to fit into the mounting holes of pin mounted auxiliary tools.

The standoff brackets 100 have recesses 108 to provide clearance for the quick attachment frame 24 adjacent the retainer channel or rim 53, and also have reinforcement portions 110 that are welded to the channel 53 of the adapter cross plate 49.

In FIG. 10 the standoff brackets 100 and the frame 48 are shown mounted on the pin mount flanges 112 of a frame or housing 114 of a hydraulic breaker 116. The standoff brackets 100 position the adapter plate assemble 55 at the proper angle for mounting the tool onto the pins at the end of a boom or arm. The pin connections can be used to transfer the assembly 101 of the frame 48 and the standoff brackets 100 from one attachment or tool to another. Buckets, earth augers, clamshells, and a variety of other tools use pin connectors, and the assembly 101 can be used with any attachment that has the pin connectors to convert the attachment to a quick attach coupling usable with the quick attachment bracket 24.

The frame 48, including the retainer rim formed by channel 53 and the flange 52C and the retainer slot 73 are used as described to effect retaining the frame 48 in position on the attachment bracket 24.

Figure 11:
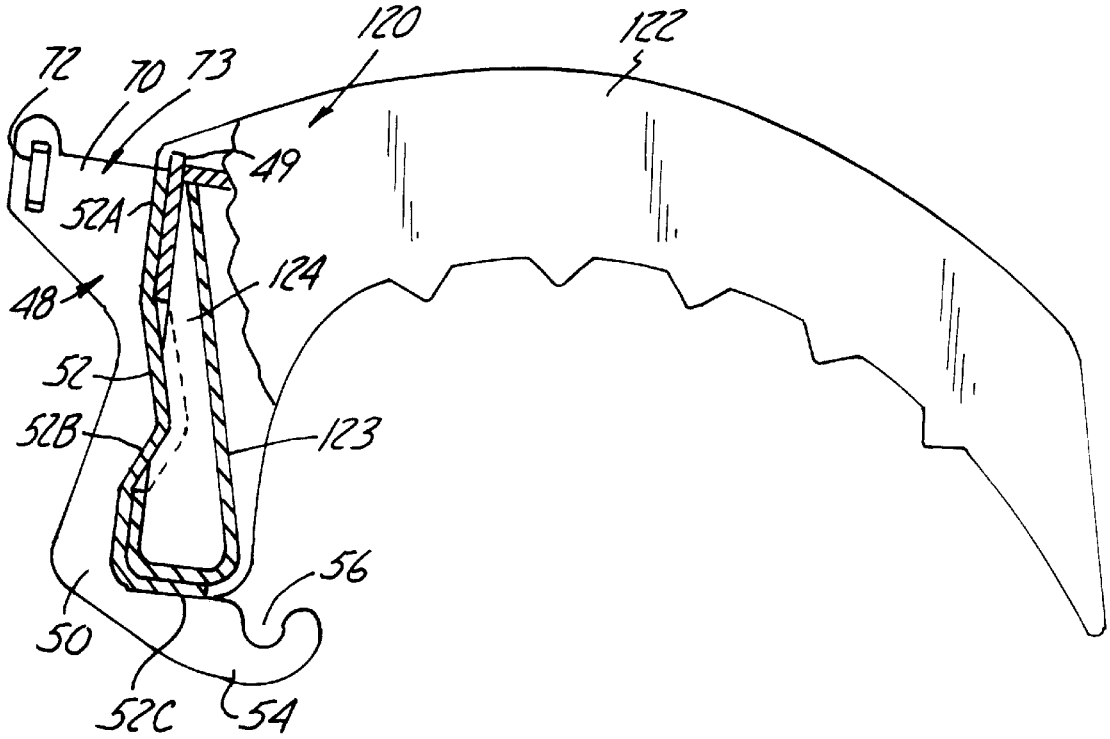
FIG. 11 is a side view of a grapple utilizing a mounting frame coupled directly to the grapple, with parts in section and parts broken away.

FIG. 11 shows a grapple 120 that has three spaced grapple teeth 122 (two are shown where the closest one is broken away). The teeth 122 are mounted on an end wall assembly 123, that is also used for mounting the frame 48. The wall 123 can be welded to the frame 48. Brackets 124 can be welded to the frame 48 if desired, and supported on the end wall of the grapple.

The frame 48 can be welded in place on the grapple and then attached to the bracket 24, as shown and described in relation to the previous figures.

Grapples are used with "thumbs" or other reaction members against which the grapple will clamp loads, and the quick attachment bracket and frame permits changing the grapple to a different style without unpinning the thumb or reaction member. This greatly simplifies changing the grapples.

It should be noted that the frame 48 is used on buckets of all sizes, and wider buckets are accommodated easily, without altering the frame.

Figure 13:
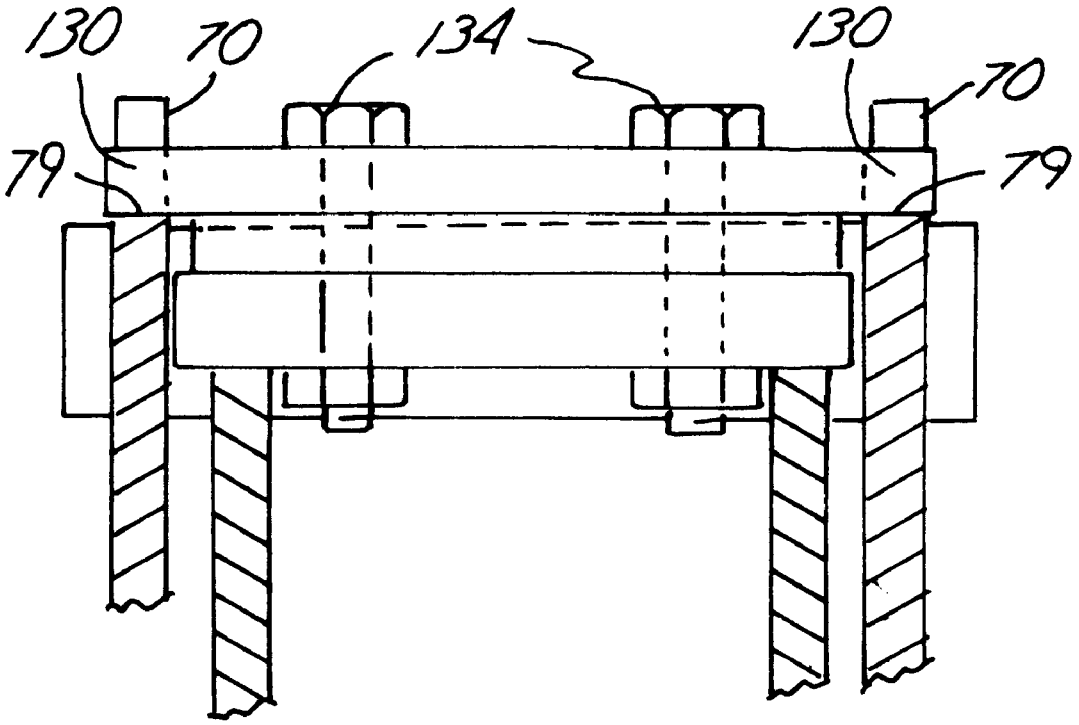
FIG. 13 is a sectional view taken on line 13—13 in FIG. 12.

FIGS. 12 and 13 show a bolt connection for securing the frame 48 to the bracket 24. The latch 41 and pawl 52, actuator 84 and spring 46 can all be eliminated from the bracket assembly. The remaining parts are numbered as in the first form of the invention. The ears 72 have flat edge surfaces 79, on which end flanges 130 of a cross bar 132 rest. The cross bar 132 has a pair of bolt holes through which bolts 134 extend and the bolts are long enough to extend through aligning holes in the nose bar 32. When the frame 48 and the bracket are slid almost into engagement, the bolts 134 can be inserted through the aligning holes on the cross bar 132 and the nose bar 32 and tightened to securely hold the bracket 24 and the frame 48 together.

The nose bar 32 and the cross bar 132 can be clamped so they are in contact when the bolts are fully tightened. This option of bolting the parts together is usable as shown with a frame that also can be used with an automatic latch, since the latch backing cross plate 52 can be used as formed for the automatic latch with the bolted connection.

Fast reliable operation for interchanging buckets or other attachments or tools is achieved. The ability to remove the bucket with the bucket off the ground without having the bucket fall freely is helpful, and is achieved by use of the overlapping ears 54 and receptacles 56 on the frame 48, in combination with the ends 38A of rod 38.

Although the present invention has been described with reference to preferred embodiments, workers skilled in the art will recognize that changes may be made in form and detail without departing from the spirit and scope of the invention.

What is claimed is:

1. A frame for attachment to an attachment bracket on an implement arm, said frame including a pair of frame side plates and a cross plate joining said side plates and holding said side plates in spaced relationship, said side plates extending outwardly from the cross plate, said cross plate having a rim along one edge for fitting into a saddle of the bracket, said frame having walls forming a retainer slot at an end of the frame opposite from the rim, said walls being of size to receive an end portion of the bracket having the saddle when the rim is retained in the saddle the walls forming the slot restraining movement of the end portion of the bracket away from the cross plate.

2. The frame of claim 1 wherein said side plates extend beyond the cross plate at an end of the frame adjacent the rim, said side plates having hook receptacles formed therein for receiving a support rod.

3. The frame of claim 1 wherein said walls forming the retainer slot comprise a portion of the cross plate extending between the side plates, the side plates defining a width of the slot, and a bar spaced from the portion of the cross plate and substantially parallel to the cross plate and supported on the side plates to define the slot.

4. The frame of claim 1 wherein said rim comprises a base wall substantially perpendicular to a plane of said cross plate.

5. The frame of claim 4 wherein said rim comprises a channel-shaped member, the base wall extending between corners formed by the base wall with joining walls perpendicular to the base wall, said corners being adapted to engage the saddle on the bracket.

6. The frame of claim 1 wherein said walls forming the slot are on an opposite side of the cross plate from the rim.

7. The frame of claim 1 and a pair of spaced standoff standoff brackets mounted on the cross plate, said brackets being formed to fit onto a tool usable with the frame.

8. The frame of claim 7 wherein said standoff brackets comprises bracket plates extending generally parallel to the side plates and being on an opposite side of the cross plate from the slot, said bracket plates having aligning hub members for receiving mounting pins for the tool.

9. The frame of claim 7 wherein said standoff bracket have planes generally parallel to the side plates and are on an opposite side of the cross plate from the slot, the standoff bracket extending to the rim and fixed thereto to provide reinforcing supports for said rim.

10. The frame of claim 1 wherein said slot has a width extending between said side plates, and said rim has a width extending between said side plates, the slot and rim being spaced along the frame between ends thereof with the saddle and such that linear motion of the frame will engage the rim with the saddle and a nose portion of the bracket on which the frame is mounted with the slot.

11. The frame of claim 10 wherein the side plates are substantially parallel and are spaced apart sufficiently to receive the bracket on which the frame is mounted.

12. The frame of claim 1 wherein said cross plate comprises a plate assembly including a first adapter plate having an opening therethrough and a second plate formed to protrude through the opening and providing a latching surface inclined relative to a central plane of the first adapter cross plate.

13. The frame of claim 12 wherein said second latch backing cross plate has a flange that forms a part of the rim between the side plates.

14. A frame for attachment to a quick attachment bracket on an implement arm, said frame including a pair of frame side plates and a cross plate having a plane, and holding said side plates in spaced relationship, said side plates extending outwardly from the cross plate and extending from a first end to a second end of the cross plate, said cross plate having a rim with at least a base wall extending laterally in a first direction from the plane of the cross plate at the first end, said frame having walls forming a retainer slot between the side plates at the second end of the cross plate, said slot having an open end between the cross plates facing toward the rim and on an opposite side of the cross plate from the base wall of the rim.

15. The frame of claim 14 wherein said side plates have end portions that extend beyond the cross plate and rim at the first end of the cross plate, said end portion of the side plates having hook receptacles formed therein, said hook receptacles being spaced from the plane of the cross plate a greater distance than the base wall of the rim.

16. The frame of claim 14 wherein said walls forming the retainer slot comprise a portion of the cross plate extending between the side plates, and a bar spaced from the portion of the cross plate and substantially parallel to the plane of the cross plate and supported on the side plates.

17. The frame of claim 14 wherein said rim comprises a channel-shaped member, a base wall extending between corners formed by the base wall and joining walls perpendicular to the base wall, said corners being adapted to engage a saddle on the bracket.

18. The frame of claim 14 wherein the space between the side plates is unobstructed between the first end of the cross plate and the slot formed at the second end of the cross plate.

19. The frame of claim 18 and standoff brackets mounted on the cross plate, said brackets being formed to attach to a tool usable with the frame.

20. The frame of claim 19 wherein said standoff brackets have mounting apertures therein for coupling to the tool.

21. The frame of claim 19 wherein said standoff brackets comprise a pair of spaced apart bracket plates perpendicular to the plane of the cross plate, and aligning apertures in the bracket plates to receive a pair of pins for mounting the tool.

22. The frame of claim 19 wherein said standoff brackets comprise a pair of bracket plates mounted to the cross plate and perpendicular thereto, and a flange extending between the bracket plates and having bolt apertures for bolting to the tool.

23. The frame of claim 14, wherein said side plates have end edges that are generally coplanar, a cross member rested on the end edges and carrying fasteners for applying a tension load to draw a member in the slot toward the cross member.

24. A method of adapting a mounting frame for an attachment bracket to be used with a plurality of different tools comprising the steps of providing a mounting frame having a plate, the plate having a center plane, providing two spaced retainers supported on the plate for mounting to the bracket, with the spaced retainer on opposite sides of the plane of the plate, and providing adapter supports for selected tools secured to the plate at portions separated from the spaced retainers.

* * * * *

UNITED STATES PATENT AND TRADEMARK OFFICE

CERTIFICATE OF CORRECTION

PATENT NO. : 6,163,989
DATED : December 26, 2000
INVENTOR(S) : Wally L. Kaczmarski et al.

It is certified that error appears in the above-identified patent and that said Letters Patent is hereby corrected as shown below:

Column 4,
Line 61, after "adapter" insert -- cross --.

Column 6,
Line 41, before "cross" insert -- adapter --.

Column 8,
Line 53, cancel "standoff";
Line 54, before "brackets" (second occurrence) insert -- standoff --;
Line 57, cancel "comprises" and insert -- comprise --;
Line 61, cancel "bracket" and insert --brackets--.

Column 10,
Line 12, before "brackets" insert -- standoff --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*